US008294370B2

(12) United States Patent
Kadrnoschka et al.

(10) Patent No.: US 8,294,370 B2
(45) Date of Patent: Oct. 23, 2012

(54) HIGH FREQUENCY GENERATOR FOR ION AND ELECTRON SOURCES

(75) Inventors: Werner Kadrnoschka, Germering (DE); Anton Lebeda, Neubiberg (DE); Rainer Killinger, Recklinghausen (DE); Johann Mueller, Munich (DE); Stefan Weis, Weilburg (DE)

(73) Assignee: Astrium GmbH, Munich (DE)

( * ) Notice: Subject to any disclaimer, the term of this patent is extended or adjusted under 35 U.S.C. 154(b) by 1094 days.

(21) Appl. No.: 12/182,645

(22) Filed: Jul. 30, 2008

(65) Prior Publication Data

US 2009/0058303 A1 Mar. 5, 2009

(30) Foreign Application Priority Data

Aug. 2, 2007 (DE) ..... 10 2007 036 592

(51) Int. Cl.
*H01J 7/24* (2006.01)

(52) U.S. Cl. ..... 315/111.51; 315/111.21; 315/111.41; 315/111.04

(58) Field of Classification Search ..... 315/111.51, 315/111.21, 111.41, 111.01
See application file for complete search history.

(56) References Cited

U.S. PATENT DOCUMENTS

| | | | | |
|---|---|---|---|---|
| 4,507,588 | A | 3/1985 | Asmussen et al. | |
| 5,770,922 | A | 6/1998 | Gerrish et al. | |
| 5,824,606 | A | 10/1998 | Dible et al. | |
| 6,378,290 | B1 | 4/2002 | Killinger et al. | |
| 6,756,737 | B2 * | 6/2004 | Doi et al. | 315/111.51 |
| 2003/0215373 | A1 | 11/2003 | Reyzelman et al. | |
| 2007/0114945 | A1 | 5/2007 | Mattaboni et al. | |

FOREIGN PATENT DOCUMENTS

| | | | |
|---|---|---|---|
| DE | 197 21 676 | A1 | 1/1998 |
| DE | 199 48 229 | C1 | 5/2001 |
| DE | 697 34 706 | T2 | 8/2006 |
| WO | WO 97/21332 | A1 | 6/1997 |
| WO | WO 03/101160 | A2 | 12/2003 |
| WO | WO 2007/061879 | A1 | 5/2007 |

OTHER PUBLICATIONS

European Search Report including partial English language translation dated Oct. 11, 2010 (Seven (7) pages).

* cited by examiner

*Primary Examiner* — Tuyet Thi Vo
(74) *Attorney, Agent, or Firm* — Crowell & Moring LLP

(57) ABSTRACT

A device for coupling ionization energy into an ion or electron source, which is excited inductively or inductively-capacitively is provided. The device includes: a discharge vessel for a gas, which is to be ionized; a coupling coil, which is wound around the discharge vessel and feeds in a high frequency energy, which is required for plasma excitation; a coupling capacitor, which is electrically coupled to the coupling coil; a high frequency generator, which is electrically coupled to the coupling coil. The high frequency generator forms, together with the at least one coupling capacitor, a resonant circuit. The high frequency generator includes a PLL controller for automatic impedance matching of the resonant circuit, so that the resonant circuit can be driven at a resonant frequency.

26 Claims, 10 Drawing Sheets

HIGH FREQUENCY GENERATOR FOR ION AND ELECTRON SOURCES

CROSS REFERENCE TO RELATED APPLICATIONS

This application claims priority under 35 U.S.C. §119 to German Patent Application No. 10 2007 036 592.8-54, filed Aug. 2, 2007, the entire disclosure of which is herein expressly incorporated by reference.

BACKGROUND AND SUMMARY OF THE INVENTION

The invention relates to a device for coupling ionization energy into an ion or electron source that is excited inductively or inductively-capacitively.

In an ion propulsion system the plasma that is to be excited at a high frequency is located in an insulated vessel, the so-called discharge vessel. A coupling coil for feeding in a high frequency energy that is necessary for plasma excitation is wound around the discharge vessel. Thus, the plasma is located inside the coupling coil. If the impedance changes due to state changes—for example, changes in the density or the conductance—of the plasma, then the result is a mistuning of the resonant circuit.

In high frequency generators, which are driven at a fixed frequency, for example, 13.56 MHz, the mismatch, which occurs due to the plasma states-changing impedance of a coupling network, which connects the high frequency generator to the coupling coil, has to be compensated by a manual retuning of an impedance matching network (so-called matchbox) or an actuator. The result of the compensation is that the amount of the capacitance of a capacitor of the impedance matching network is suitably adjusted, for example, by changing the surface; or the inductance of a coil of the impedance matching network is changed by inserting a ferrite. Usually the impedance matching over an impedance matching network cannot be readjusted very quickly and can be optimally readjusted only over a small frequency load range. Specifically, the readjustment time of the impedance matching network can be in a range of seconds. Consequently a considerable amount of power is dissipated to some extent in the impedance matching networks.

Therefore, exemplary embodiments of the present invention provide a device for coupling ionization energy into an ion or electron source, which is excited inductively or inductively-capacitively, for use in an ion propulsion system. Furthermore, this device does not exhibit the above described drawbacks.

An inventive device for coupling ionization energy into an ion or electron source, which is excited inductively or inductively-capacitively, comprises: a discharge vessel for a gas, which is to be ionized—such as Xe, Kr, Ar, Ne, He, $H_2$, $O_2$, $CO_2$, Cs or Hg; a coupling coil, which is wound around the discharge vessel and feeds in a high frequency energy, which is required for plasma excitation; a coupling capacitor, which is electrically coupled to the coupling coil; and a high frequency generator, which is electrically coupled to the coupling coil and which forms together with the at least one coupling capacitor a resonant circuit. In this case the high frequency generator exhibits a PLL (phase locked loop) controller for automatic impedance matching of the resonant circuit, so that the resonant circuit can be driven at a resonant frequency.

The coupling coil is attached to the high frequency generator and forms with the coupling capacitor of the high frequency generator a series or parallel resonant circuit.

The device of the present invention corrects the phase errors of the current and the voltage in the power output stage of the high frequency generator by automatically tracking the frequency and phase of the resonant frequency of the load circuit. The control is based on the fact that the PLL control circuit continuously compares the phase angle of the sinusoidal high frequency output current and the phase angle of the generator output voltage by way of a digital phase detector, and retunes any phase errors by resetting the generator frequency by way of a voltage-controlled oscillator (VCO) to the frequency of the resonant circuit until there is zero phase error. Since the reaction time of the PLL controller is very short (depending on the design <100 microseconds), even if the resonant frequencies change quickly, the phase errors do not persist for a prolonged period of time. Therefore, the matching of the high frequency generator to the consumer is carried out with the highest possible efficiency. Owing to the very fast frequency tracking and the phase adjustment using the digital phase comparator, the PLL controller provides that the current and the voltage are always in phase, and, thus, the maximum power can be coupled into the plasma by way of the coupling coil. This step can take place without mechanical motion or in a different way. The device of the present invention is characterized by its simplicity and high flexibility and its applicability over a wide frequency range.

Thus, the method of the present invention for optimal impedance and power matching involves adjusting the power, output by the high frequency generator, with respect to resonance and zero phase error by way of a PLL control circuit (PLL=phase locked loop) and transferring this power to the plasma. The transfer of the power with a zero phase error means that the current and the voltage in the resonant circuit are in phase; and, thus, no reactive currents flow. Therefore, there can also be no reactive power losses, as a result of which switching losses are virtually eliminated.

In order to carry out the automatic impedance matching of the resonant circuit, the current and the voltage in the resonant circuit are detected and fed to the PLL controller as the controlled variables.

The high frequency generator can operate such that resonance and optimal phase adjustment is possible. Owing to the PLL controller only sinusoidal currents flow in both the high frequency generator and in the resonant circuit and, thus, in the coupling coil. The sinusoidal current allows the high frequency generator to operate at a high efficiency, which ranges from 90 to 95%, even at high operating frequencies, that is, frequencies above 0.5 MHz.

A device with a high frequency generator with PLL control according to the present invention always works at the resonant frequency of the coupling network of the ion or electron source. The coupling network of the invention is formed by the resonant circuit that includes the coupling coil and the coupling capacitor. This means that the high frequency generator follows phase-accurately all frequency changes, independently of a frequency mistuning or the frequency bandwidth circuit quality, by means of the PLL control. The power matching of the high frequency generator occurs in the microsecond range and results, due to the exact phasing of current and voltage in the switching elements of the high frequency generator and the resonant circuit, in an almost non-dissipative switching and an optimal power coupling into the plasma.

Therefore, the inventive device is especially suited for the high frequency energy supply of ion sources (TWK) and electron sources (NTR) with inductive excitation and for applications, in which minimum energy consumption is a crucial criterion.

According to one embodiment, the PLL controller carries out a frequency and/or phase control for impedance matching of the resonant circuit. The power of the high frequency generator can be controlled by setting an input direct voltage and an input current of the high frequency generator. Therefore, the high frequency generator generates a high frequency output voltage from a direct voltage source, the voltage and current intensity of which can be controlled. This alternating voltage source is connected to a resonant circuit with the inclusion of the coupling coil, which is necessary for an inductive coupling, and the additional coupling capacitor.

In another aspect of the present invention the high frequency generator of the inventive device is connected to the coupling coil without interposing an impedance matching network, a so-called matchbox. Nevertheless, the attachment of the high frequency generator exhibiting the PLL control allows the electric energy to be coupled directly into the plasma of the ion or electron source over a wide power and frequency range.

The resonant circuit, which includes the coupling coil and the coupling capacitor, can be designed, by choice, as a series or parallel resonant circuit. In this case the impedance matching is achieved by including the coupling coil and the structural coupling capacitances between the plasma and the discharge vessel and the corresponding leads in the series or parallel resonant circuit, so that the result is an automatic frequency and phase control by means of the PLL controlled high frequency generator.

In another aspect the coupling coil can have a center tap, to which is attached the high frequency generator. This configuration allows the coupling coil to cool by feeding in a coolant without interposing insulators, because the coil ends of the coupling coil are connected to a reference potential. Water can be used as the cooling medium. The ground potential can serve, for example, as the reference potential.

In another aspect the coupling coil can be disposed between two or more coupling capacitors. In this case it is desirable for the resonant circuit, which forms, to form a resonant frequency, which is inside the lock-in frequency of the PLL controller. The high frequency generator tracks the frequency, for example, using a voltage-controlled oscillator (VCO) and a digital phase comparison between the current and the voltage in the resonant circuit until the phase error becomes zero.

Another aspect provides that the high frequency generator is connected to the coupling coil without interposing electronic components for an intermediate transformation. An alternative aspect provides that the at least one coupling capacitor and the coupling coil are attached to the high frequency generator by way of a transformer. This design may be practical especially if very extensive impedance matching is necessary. In this case the primary side the transformer is capacitively coupled to the high frequency generator and the secondary side to the at least one coupling capacitor; and the coupling coil forms the resonant circuit. It is expedient to provide a device, which detects the current and the voltage in the resonant circuit and which is coupled to the PLL controller, in order to feed to this said controller the measured current and the measured voltage as the controlled variables.

Another aspect of the invention provides that the at least one coupling capacitor is disposed in the high frequency generator or outside this high frequency generator (as an external component).

Furthermore, it can be provided that the coupling coil is grounded on one side or is operated insulated from a ground potential.

Another aspect provides that the coupling coil and the plasma form a transformer, the plasma constituting a secondary winding of the transformer.

The high frequency generator comprises a power output stage, which can be configured as one of: a half bridge class D output stage; a full bridge class D output stage; a push pull output stage; an output stage of class E; an output stage of class F; an output stage of class C. The choice as to which power output stage will be provided in the high frequency generator depends on the required frequency and power range. In all cases the impedance matching to the coupling resonant circuit is done via a frequency/phase control by the PLL controller.

Preferably class D and class E output stages are used as the output stages for the high frequency generator. These output stages are characterized by a maximum current flow angle of 180° in the switching elements of the output stages (with bipolar or MOSFET transistors). If class D output stages are used without PLL control in connection with resonant circuits, then even the smallest frequency/phase mistuning, as a function of the circuit quality of the resonant circuit, will lead to considerable resistive currents of both a capacitive or inductive nature, depending on the direction of the phase/frequency mistuning. As a result, there are very high current loads in the output stage and consequently high losses in the output stages and coupling networks. The losses occur in the form of resistive current losses, which in turn lead to a steep reduction in the power that is transmitted to the consumer. The use of the PLL control completely alleviates the aforementioned problems, that is, the phase error in the output stages, even in the case of class D, class E and class F output stages. The use of the PLL control makes it possible to totally utilize the performance of these types of output stages, that is, a current flow angle of 180°.

Owing to the high frequency generator, a resonant frequency can be set in a range of 0.5 MHz to 30 MHz. The power that is coupled into the high frequency generator is in a range of 1 W to 10 kW. The load impedance, which is coupled to the high frequency generator, is in a range of 0.1 ohm to 1 ohm or in a range of 1 ohm to 50 ohms.

In another aspect the discharge vessel of the inventive device includes a gas inlet and an outlet, which is configured opposite said gas inlet, with at least two extraction grids (each of which has one multi-apertured mask), which serves as the electric lens for focusing the ion beams to be extracted. The extraction takes place by using an electric field that is applied to the extraction grid. The discharge vessel is made of a non-conducting material exhibiting low high frequency losses, such as quartz, ceramic, Vespel or boron nitride. The discharge vessel serves as the discharge chamber for the gas that is to be ionized.

According to another aspect, the coupling coil comprises a single layered or a multi-layered or a bifilar winding. In this case the coupling coil is wound around the discharge vessel or disposed inside the discharge vessel. The coupling coil is wound about the discharge vessel in a cylindrical, conical, spherical or partially conical manner with a cylindrical transition body.

Other objects, advantages and novel features of the present invention will become apparent from the following detailed description of the invention when considered in conjunction with the accompanying drawings.

BRIEF DESCRIPTION OF THE DRAWINGS

The invention is explained in detail below with reference to the figures.

DETAILED DESCRIPTION OF THE DRAWINGS

Figure 1:
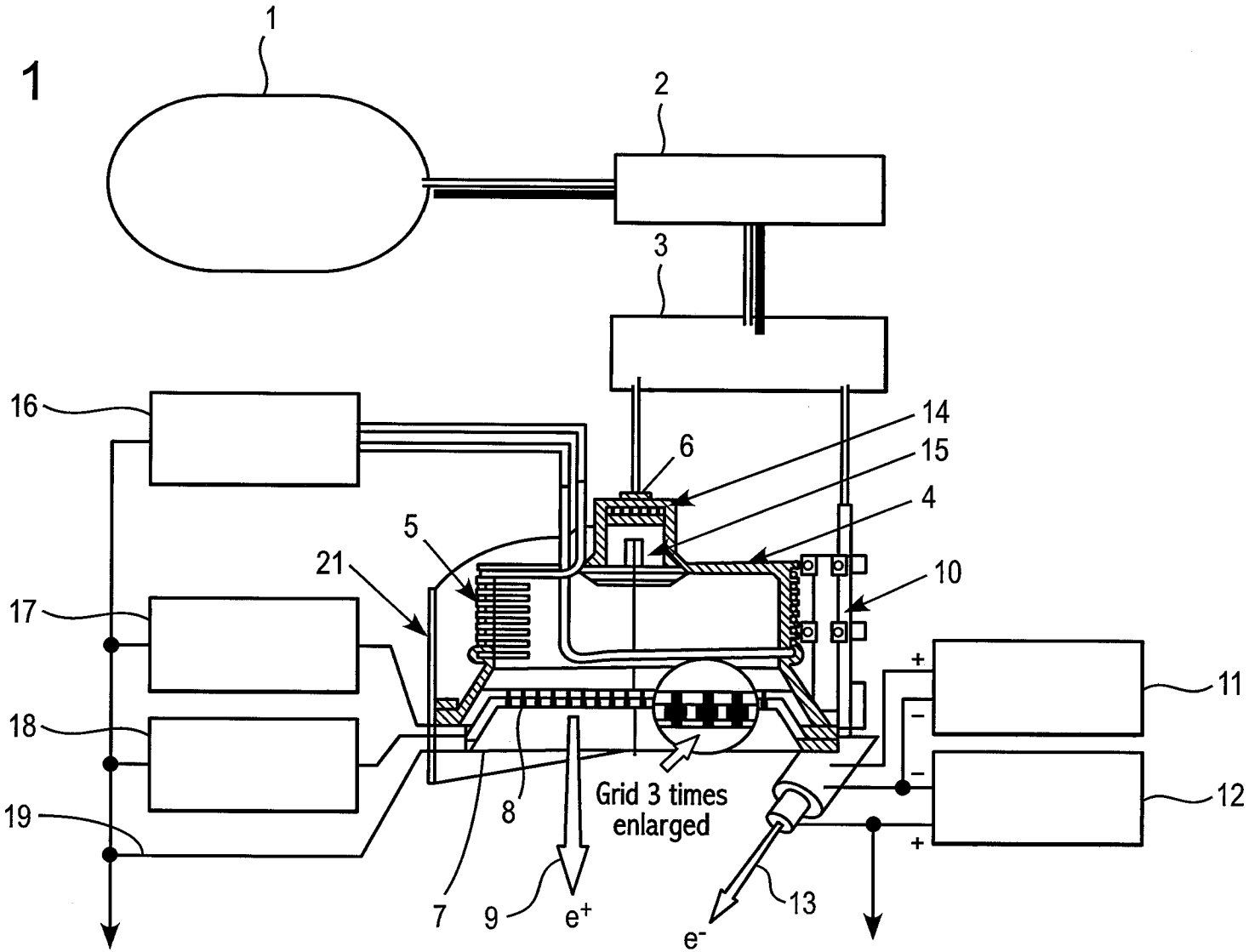
FIG. 1 is a schematic drawing of an inventive device for coupling ionization energy into an ion or electron source.

FIG. 1 is a schematic drawing of an inventive device for coupling ionization energy into an ion or electron source. A gas tank 1, in which a gas that is to be ionized is stored under high pressure, is coupled to a fill and outflow area 2 by way of a line. The fill and outflow area 2 is coupled to a flow control unit 3 by way of another line. This flow control unit includes two outputs. A first output is connected to an inlet 6 of a discharge vessel 4 for ionization of the gas. A second output of the flow control unit 3 is connected to a neutralizer 10. The discharge vessel 4 is made of a non-conducting material, which exhibits only small high frequency (HF) losses. The discharge vessel 4 can be made, for example, of quartz, a ceramic, Vespel or boron nitride. The discharge vessel 4 serves as the discharge chamber for the gas that is to be ionized, for example, Xe, Kr, Ar, Ne, He, $H_2$, $O_2$, $CO_2$, Cs or Hg.

The inlet 6 of the discharge vessel 4 includes an insulator 14 as well as a flow limiter 15. A coupling coil 5 is wound about a cylindrical section of the discharge vessel 4, which is coupled to the inlet 6. The coupling coil 5 can be made of a single layered, multi-layered or bifilar winding, which is wound both around and inside the discharge vessel. Therefore, the shape of the winding of the coupling coil is arbitrary. It can be cylindrical, conical, spherical or partially conical with a cylindrical transition body. The discharge vessel 4 with the coupling coil 5, enveloping said discharge vessel, as well as the neutralizer 10 are surround by a propulsion system housing 21.

The coupling coil 5 is connected to a high frequency generator 16, which generates a high frequency output voltage from a direct voltage source, of which the voltage and current intensity can be controlled. Together with a coupling capacitor (not illustrated) which is provided in the high frequency generator 16, the coupling coil 5 forms a resonant circuit. The high frequency generator, which can carry out a field coupling on an inductive basis and/or on a combined inductive and capacitive basis, is suitable for use in a frequency range of 0.5 MHz to 30 MHz. At the same time the high frequency generator can reach an efficiency that ranges from 90 to 95%.

The outlet 7 of the discharge vessel 4 exhibits at least two, preferably two or three, extraction grids 8, each of which exhibits at least one multi-apertured mask. The extraction grids 8 serve as the electric lens for focusing the ion beams, which are to be extracted. The extraction takes place using an electric field applied to the extraction grids 8. For this purpose, the extraction grids 8 are connected to an accelerator 18 and a plasma holder 17 (also called "plasma holder"), both of which exhibit different potentials. Whereas the plasma holder 17 has the function of an anode and generates a voltage of +1200 volts, the accelerator 18 provides a voltage of −250 V. Furthermore, a decelerator 19 is attached to the extraction grids. The reference numeral 9 marks the direction in which the positively charged ion beam e+ is expelled from the extraction grid 8. The positively charged ion beam is compensated using negatively charged electrons at the output of the discharge vessel 4, in order to prevent an electric charging of the device. The reference numeral 13 marks the expulsion direction of the electrons e−, thus expelling them from the neutralizer 10.

The neutralizer 10 comprises a cathode heater 11 and a neutralizing unit 12. One electrode of the cathode heater 11 is connected to one electrode of the neutralizing unit 12. Another electrode of the cathode heater 11 and the neutralizing unit 12 respectively is coupled to the neutralizer 10. Between the electrodes of the cathode heater 11 there is, for example, a 9 V difference in the potential, whereas between the electrodes of the neutralizing unit 12 there is a 15 V difference in the potential.

Figure 2:
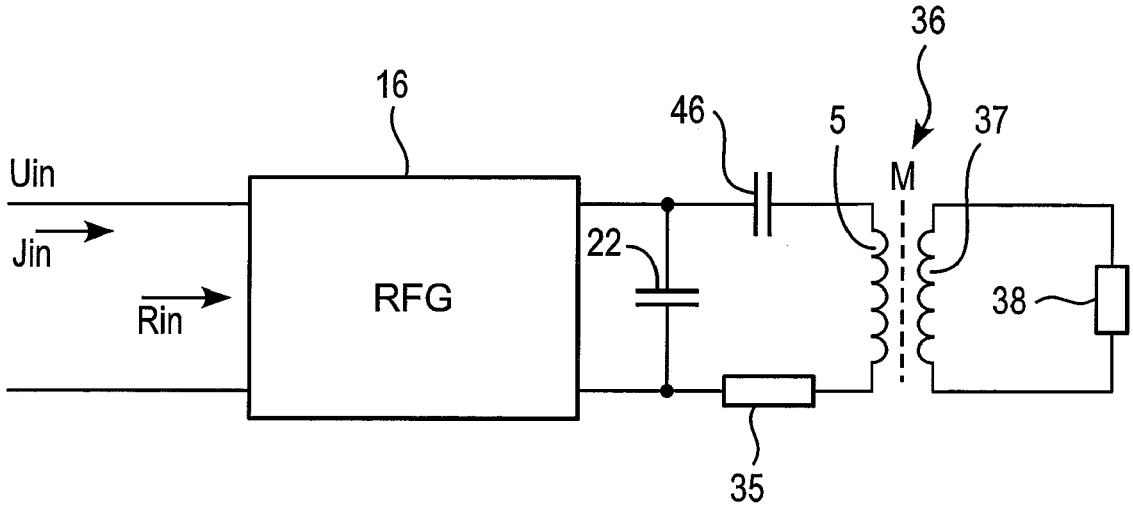
FIG. 2 is an equivalent electric circuit diagram of the inventive device.

A simple equivalent electric circuit diagram of the invention is shown in FIG. 2. The equivalent electric circuit diagram takes into consideration not only the inventive device but also the plasma in the discharge vessel. The coupling coil 5 and the plasma work in the simplified sense like a transformer (reference numeral 36), where the plasma represents a secondary winding 37 of the transformer 36. The primary winding is formed by the coupling coil 5. The resistors 35 and 38 represent the line resistances. The reference numeral 22 marks the coupling capacitor, which forms together with the coupling coil 5 the resonant circuit. The resonant circuit contains the parasitic components (resistor 35 and capacitor 46). The parasitic capacitor 46 represents, for example, the capacitances of a (coaxial) cable and output transistors. In the event of short line lengths and frequencies below 3 MHz, the capacitance of the parasitic capacitor 46 can be ignored. A high frequency generator 16 is connected to the feeding voltage source, so that the input voltage Uin and the input current Jin are applied. On the output side the high frequency generator 16 is attached to the coupling capacitor 22. The high frequency generator is also marked with RFG (radio frequency generator) in the figures.

Figure 3:
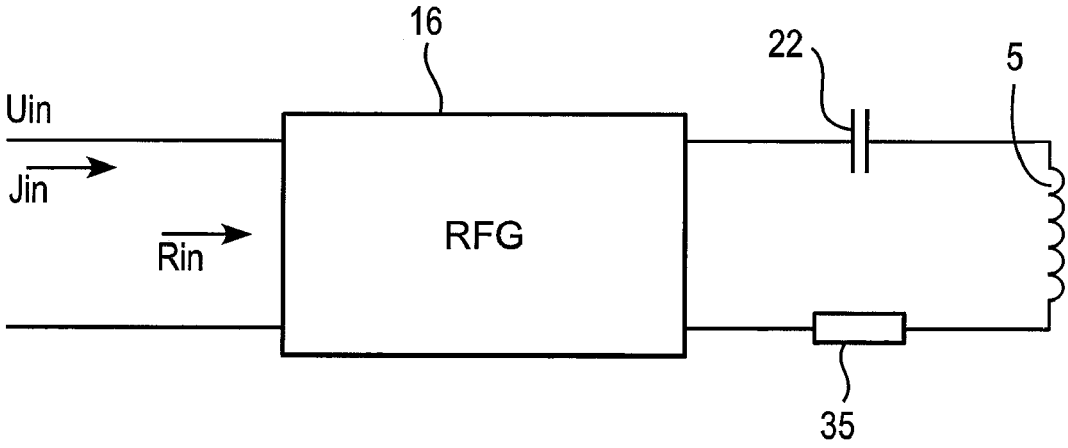
FIG. 3 is a simplified equivalent electric circuit diagram of the inventive device.

FIG. 3 is a simplified equivalent electric circuit diagram of the inventive device. The high frequency generator 16 is connected to the feeding voltage source, so that the input voltage Uin and the input current Jin are applied. On the output side the high frequency generator 16 is connected in series to the coupling coil 5 by way of the coupling capacitor 22. The resistor 35 represents a line resistance. In other words, this means that the coupling coil 5, which is usually wound around the discharge vessel, is connected to the coupling capacitor to form a series or parallel resonant circuit.

Figure 6:
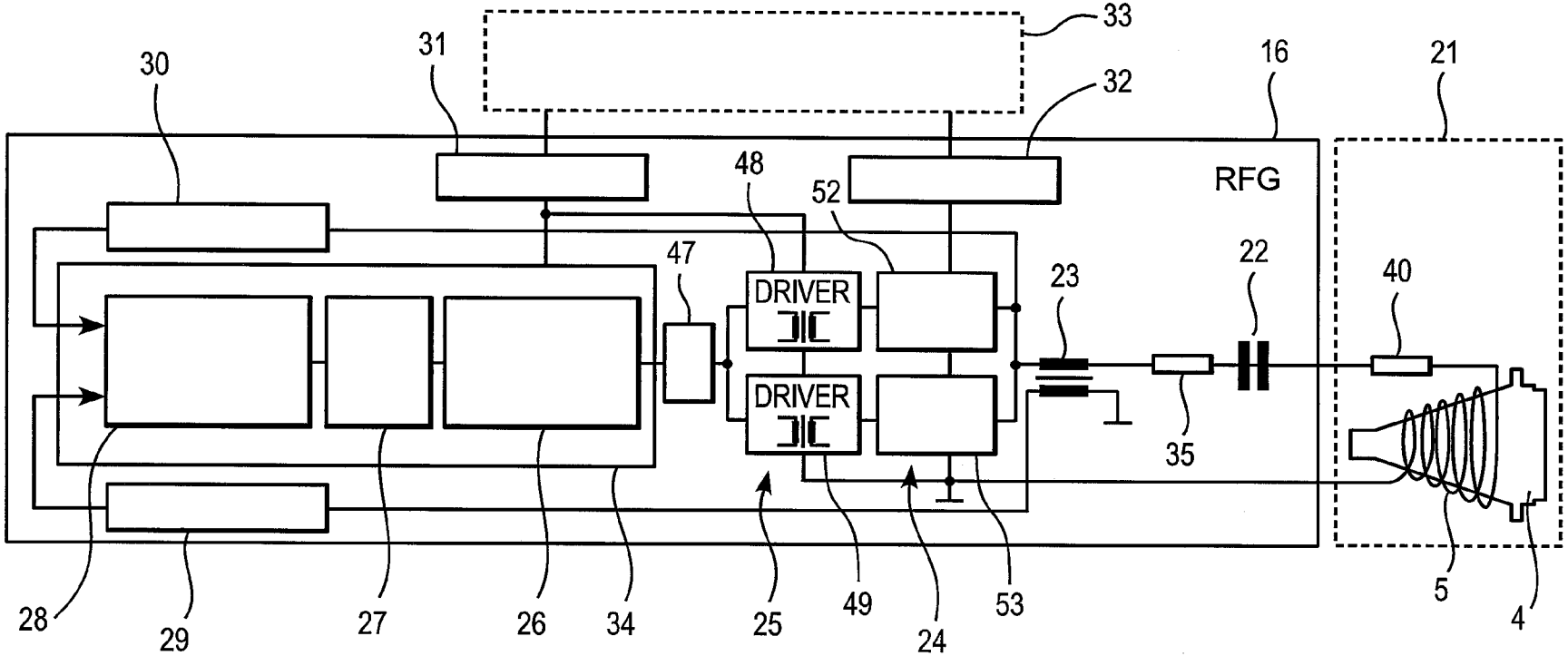
FIG. 6 is a schematic drawing of the components of the device according to the invention.
Figure 7:
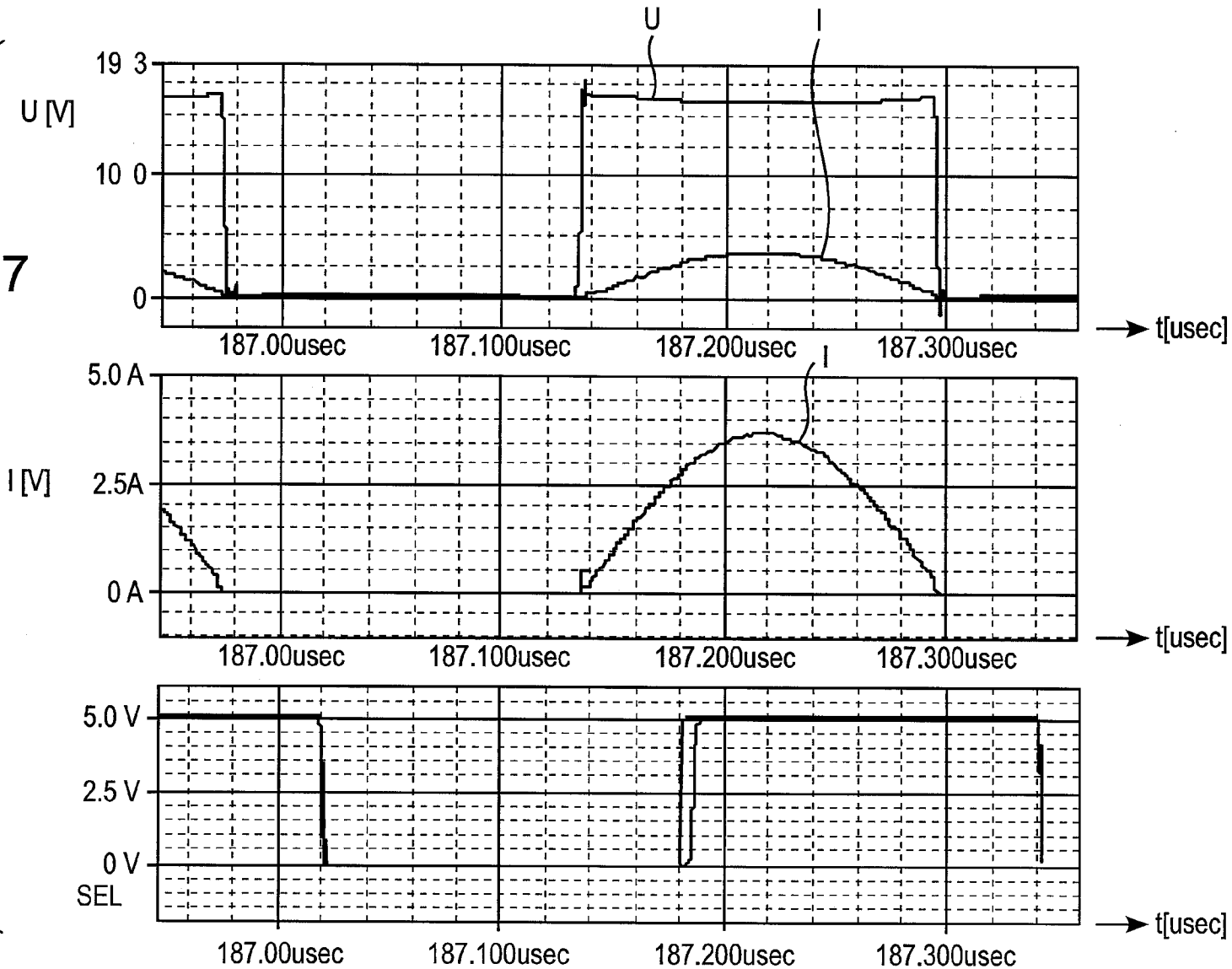
FIG. 7 shows the variations with time of the current and the voltage at an output of the high frequency generator.

FIG. 6 is a schematic drawing of the components of the device according to the invention. The invention is characterized in that the high frequency generator 16 generates a high frequency output voltage from a direct voltage source (energy supply 33), the voltage and current intensity of which can be controlled. This high frequency generator 16 is connected to a resonant circuit with the inclusion of the coupling coil 5, which is necessary for an inductive coupling, and an additional resonance capacitor, the coupling capacitor 22. For an optimal impedance and power matching, the power, generated by the high frequency generator 16, is transmitted over a frequency and phase-guided control circuit, adjusted with respect to resonance and zero phase error. This can be achieved, for example, by the variation with time of the current and the voltage at the output of the high frequency generator in FIG. 7. The upper (rectangular) curve replicates the voltage U; the center (sinusoidal) curve replicates the current I; and the bottom curve replicates the drive of the output stage. In addition, the top figure shows the current, in order to elucidate the phase coincidence. Zero phase error means that the current and the voltage in the resonant circuit are in phase, so that no resistive currents flow. Therefore, there can also be no reactive power losses, as a result of which switching losses are virtually eliminated. Due to the operation with resonance and optimal phasing, produced by a PLL controller, only sinusoidal currents flow in both the switching elements of the high frequency generator 16 and in the resonant circuit and, thus, in the coupling coil 5. The sinusoidal current allows the switching of switching elements during the zero crossing of the current. Thus, a high efficiency in a range of 90 to 95% can be achieved.

The control circuit is formed, as explained above, using the coupling coil 5 and the coupling capacitor 22, which is disposed inside the high frequency generator 16 in the embodiment, shown in FIG. 6. In an alternative (not illustrated) embodiment, the coupling capacitor 22 could also be designed as an external component. Furthermore, two resistors 35 and 40, which represent the line resistances, are connected in the resonant circuit. The coupling capacitor 22 is coupled over a line to a power stage (output stage) 24, so that the current flowing in this line is detected with a current measuring device 23. The output stage 24 is designed, for example, as a class D output stage and is driven by a driving circuit 25, which comprises a flip-flop 47 and driver stages 48, 49. The driver stages 48, 49 drive the output stages 52, 53 of the output stage 24 by way of transformers. The driving circuit 25 in turn is connected to a PLL controller 34. This controller comprises a voltage-controlled oscillator 26 (VCO), a filter 27, which is coupled to said oscillator, and a digital phase comparator 28, which is coupled to the filter 27. The PLL controller 34 is coupled to the external energy supply 33 by way of an input filter 31. The output stage 24 is also connected to the energy supply 33 by way of an input filter 32. The PLL controller 34, more specifically the digital phase comparator 28, receives as the input signal a current, which is measured by the current measuring device 23 and which is amplified by a signal amplifier 29. Furthermore, the voltage, applied to the output of the output stage 24, is fed over another signal amplifier 30 to an input of the digital phase comparator 28. The power matching can take place in the microsecond range by an exact phasing of the current and the voltage in the switching elements of the drive circuit 25 and the resonant circuit and leads to an almost non-dissipative switching of the output stage 24 and, thus, an optimal power coupling into the plasma, introduced into the discharge vessel 4.

Therefore, such a high frequency generator with PLL control is especially suited for the high frequency energy supply of ion sources (TWK) and in electron sources (NTR) with inductive excitation and for applications, in which minimum energy consumption is a crucial criterion.

The invention makes it possible to use, as the output stage in the high frequency generator 16, half bridges in connection with a PLL frequency and phase control as well as a resonant circuit coupling. The embodiment in FIG. 4 constitutes a series resonant circuit, which can operate in a frequency and power range between 600 kHz and 14 MHz and/or between 1 W and 3 kW. The output stage 24, which is designed as the half bridge, is connected between a supply terminal and a reference potential terminal and comprises, as well-known, two switching elements 44 (in the embodiment in the form of MOSFETs), which are connected together in series to their load domains.

These MOSFETs are driven by the driving circuit 25. The coupling capacitance 22 is coupled to a node 39, which is connected to a main terminal of the switching elements 44. A resistor 45 of the resonant circuit, which represents a coil resistance, is connected to the reference potential, for example, ground. The switching elements 44 are driven by the driving circuit 25, which is connected to an energy supply, whose current and voltage can be varied.

Figure 5:
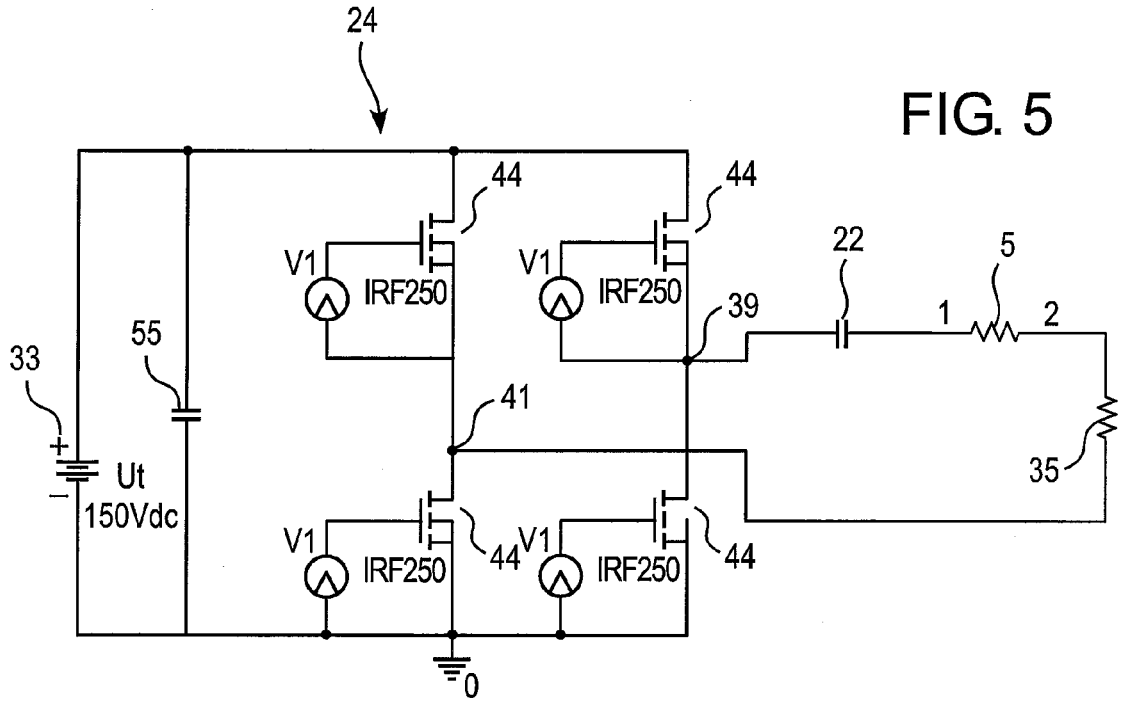
FIG. 5 is a basic circuit diagram of an output stage (configured as a full bridge) of a high frequency generator with a series resonant circuit.

FIG. 5 is an additional basic circuit diagram of an output stage 24 of a high frequency generator, said output stage 24 being configured as a full bridge. An output stage, which is configured as a full bridge, is suitable for a frequency range between 600 kHz and 5 MHz and a power range between 2 kW and 10 kW. The output stage 24 comprises, as well-known, two half bridge branches, which are connected in parallel and are connected between a supply terminal and a reference potential terminal. Each of these two half bridge branches comprises two switching elements 44 in the form of MOSFETs, which are connected in series to their load domains. The resonant circuit, comprising the coupling coil 5, the coupling capacitor 22 and the line resistor 35, is connected to a node 39 of a first half bridge and a node 41 of a second half bridge of the output stage 24. Furthermore, the energy supply 33 is connected in parallel to a smoothing capacitor 55.

Figure 4:
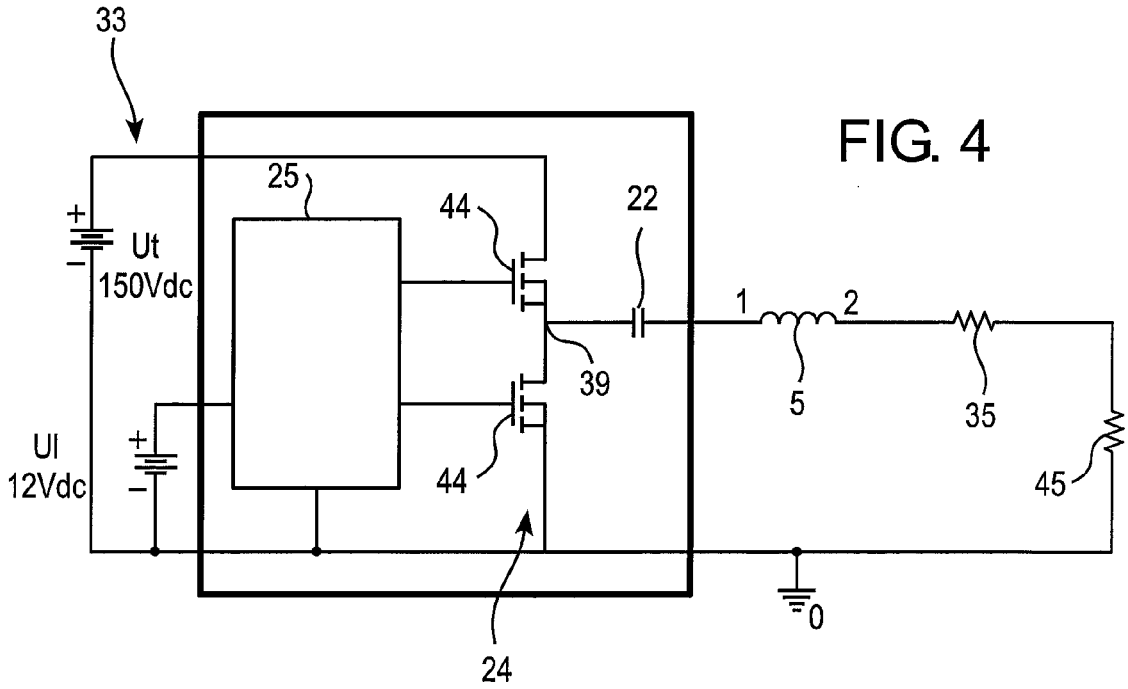
FIG. 4 is a basic circuit diagram of an output stage (configured as a half bridge) of a high frequency generator with a series resonant circuit.

For the sake of a better overview, FIGS. 4 and 5 do not show either the driving circuit for driving the switching elements 44 or the PLL controller for matching the frequency and the phase.

Figure 8:
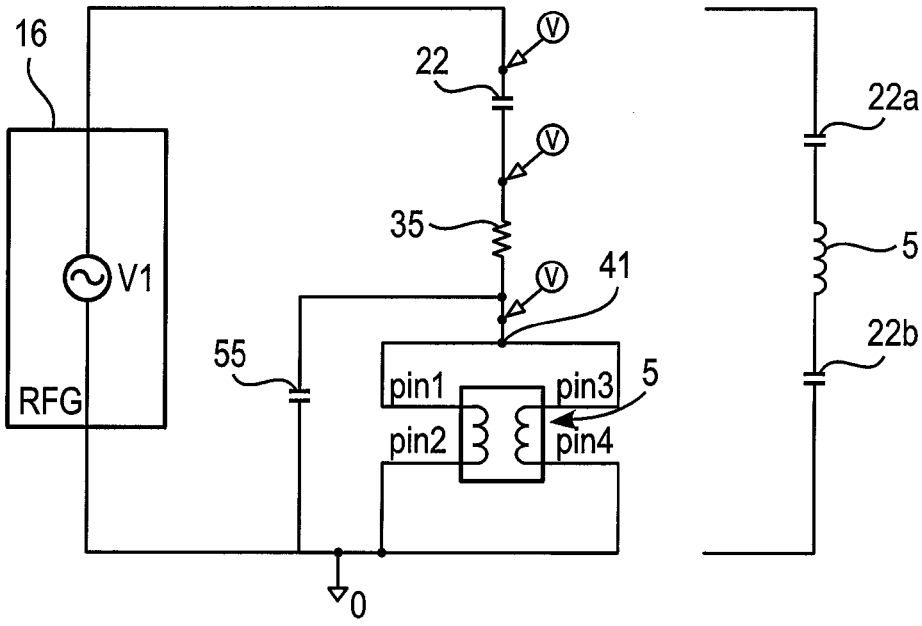
FIG. 8 is an electric circuit diagram of two options for coupling the coupling coils to a high frequency generator.

FIG. 8 is an electric circuit diagram of options for coupling the coupling coils to a high frequency generator. The high frequency generator 16 can be coupled to the ion source or the electron source by way of a simple series resonant circuit or parallel resonant circuit in connection with a PLL phase control. Similarly the coupling can take place by way of a series/parallel resonant circuit. In this case the coupling coil 5 exhibits a center tap (left half of FIG. 8). The two free ends of said coupling coil can be connected to one reference potential respectively, in the embodiment ground. To this end, a capacitor 55 is connected in parallel. For the sake of simplicity, the PLL frequency/phase control is not illustrated. Furthermore, the resonant circuit comprises the coupling capacitor 22 as well as a line resistor 35. A voltage, fed to the PLL control circuit, is picked off via the resistor 35, these points being marked with the letter v. The current, which is fed to the PLL control circuit as the controlled variable, is tapped at the point, labelled 1. The right half of FIG. 8 selects a current, where the coupling coil 5 is disposed between two coupling capacitors 22*a* and 22*b*. Both ends of the coupling coil 5 are capacitively connected. The line resistance is not illustrated. Furthermore, the drawing does not show either the PLL frequency-phase control or the high frequency generator, both of which are provided according to the inventive idea. The described coupling significantly increases the efficiency of the high frequency generator and the efficiency of the ion source or the electron source. In both modules there are no resistive currents, as a result of which the respective power loss decreases. Through an optimal choice of the number of windings of the coil, both an optimal plasma coupling and optimal operating parameters (operating voltage and current) of the high frequency generator can be achieved.

Figure 9:
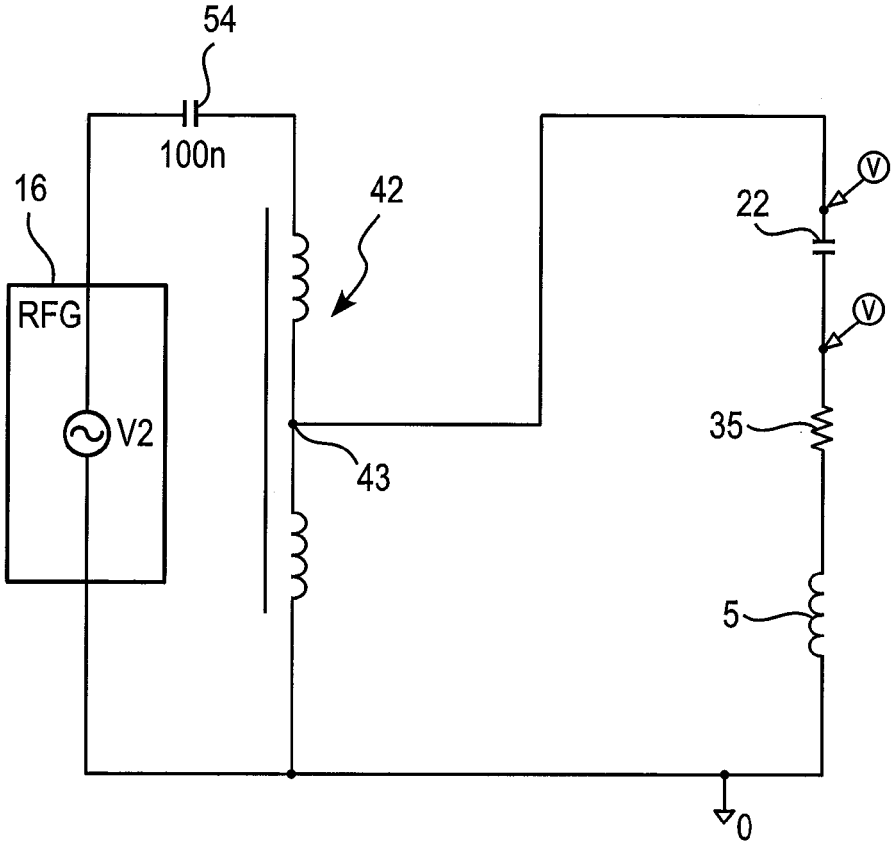
FIG. 9 is a drawing of one example of the coupling of a coupling coil by way of an additional transformer to the high frequency generator.

FIG. 9 is a schematic drawing of one example for coupling a coupling coil by way of an additional transformer 42 to the high frequency generator 16. Owing to the additional transformer 42 an additional transformer-induced impedance matching, in particular in a frequency and power range between 600 kHz and 5 MHz and/or between 1 W and 1 kW, is possible. In the embodiment the additional transformer 42 includes a center tap 43. A capacitor 54, which is connected downstream of the high frequency generator 16, is used for direct voltage uncoupling of the additional transformer 42.

Figure 10:
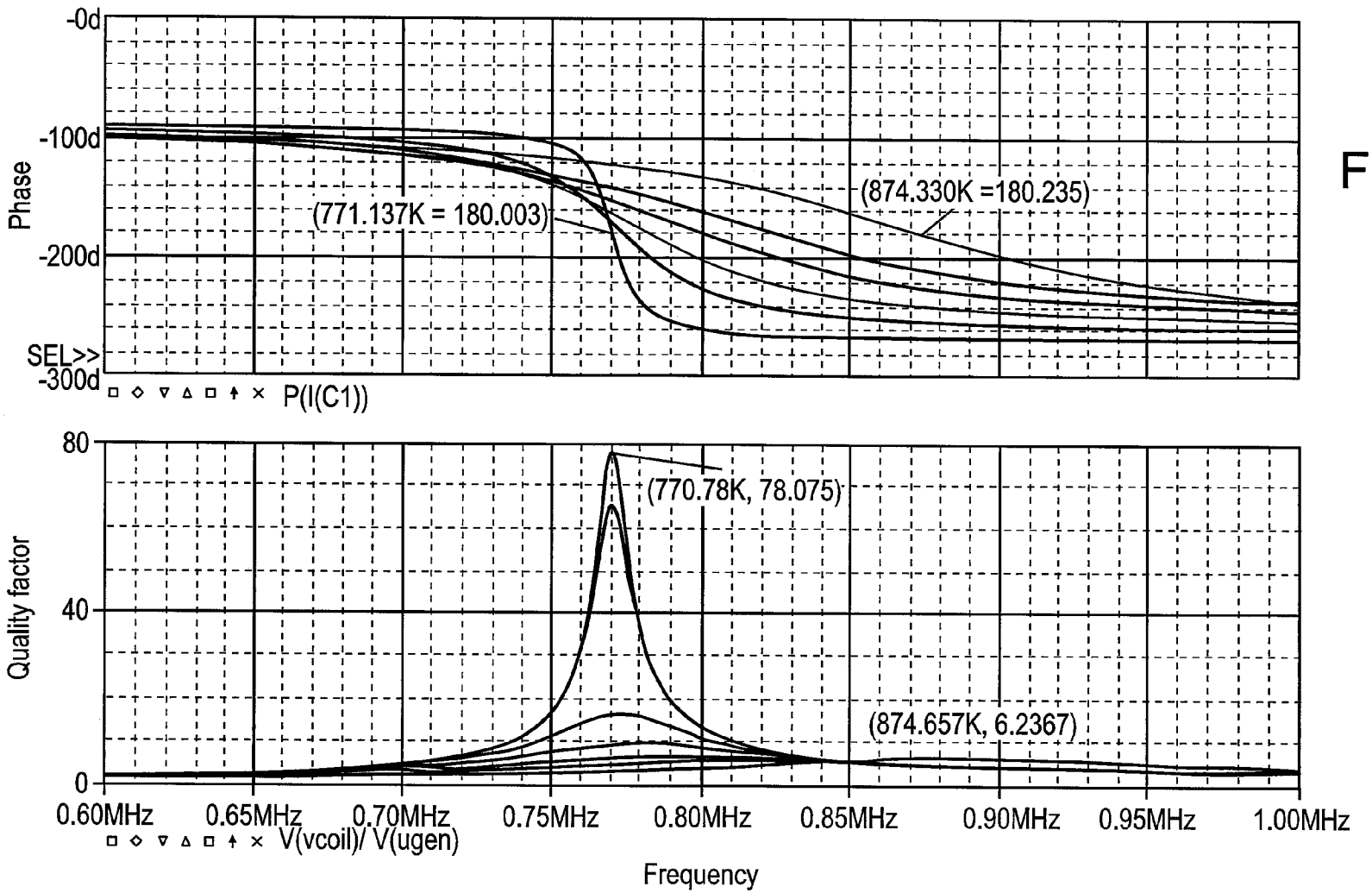
FIG. 10 is a drawing of the frequency bandwidths and the resonant circuit quality and/or the frequency mistuning as well as the phase response of an ion source at various plasma states.

FIG. 10 is a drawing of the frequency bandwidths and the resonant circuit quality and/or the frequency mistuning as well as the phase response of an ion source at various plasma states. The different quality curves of the resonant circuit are caused by the different impedances of the plasma because of the different degrees of ionization. Thus, the steepest curve in the bottom graph has the highest quality and the narrowest bandwidth. The drawing illustrates that the inventive control circuit reacts to very different types of qualities and latches in the stable state. The curves in the upper half of the figure show that, when the plasma impedances change, the results are ion currents of varying phase angles, a state that is compensated by the phase control circuit.

Figure 11:
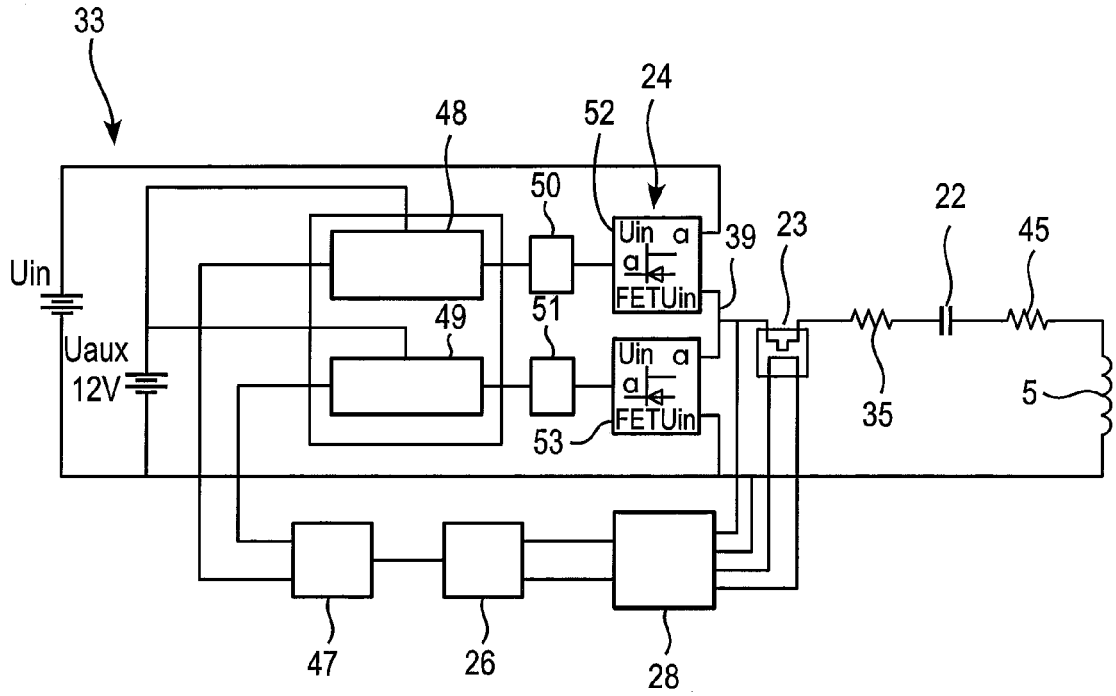
FIG. 11 is an equivalent electric circuit diagram of a device with a high frequency generator and a class D half bridge with PLL control.

FIG. 11 is another basic circuit diagram, which shows the use of the PLL controller for controlling the high frequency generator. In the example the output stage 24 is designed as a class D half bridge. In this case the resonant circuit is coupled to the node 39. Between the node 39 and a resistor 35 there is a current measuring device 23. The resistor 35 represents a line resistance. The resistor 45, which is connected in series thereto, represents a coil resistance. A voltage is tapped between the node 39 and a reference potential. This voltage and a current, which is measured by means of the current measuring device 23, are fed to the inputs of a phase comparator 28. The output voltage, applied to the phase comparator 28, is fed in so as to be filtered at the input of the voltage-controlled oscillator 26. This control voltage is changed by the phase comparator, which has the function of an error amplifier, until its inputs exhibit a frequency and phase coincidence. Driver stages 48, 49, which actuate and/or drive the output stages 52, 53 over the transformers 50, 51, are driven over a flip-flop 47.

Figure 12:
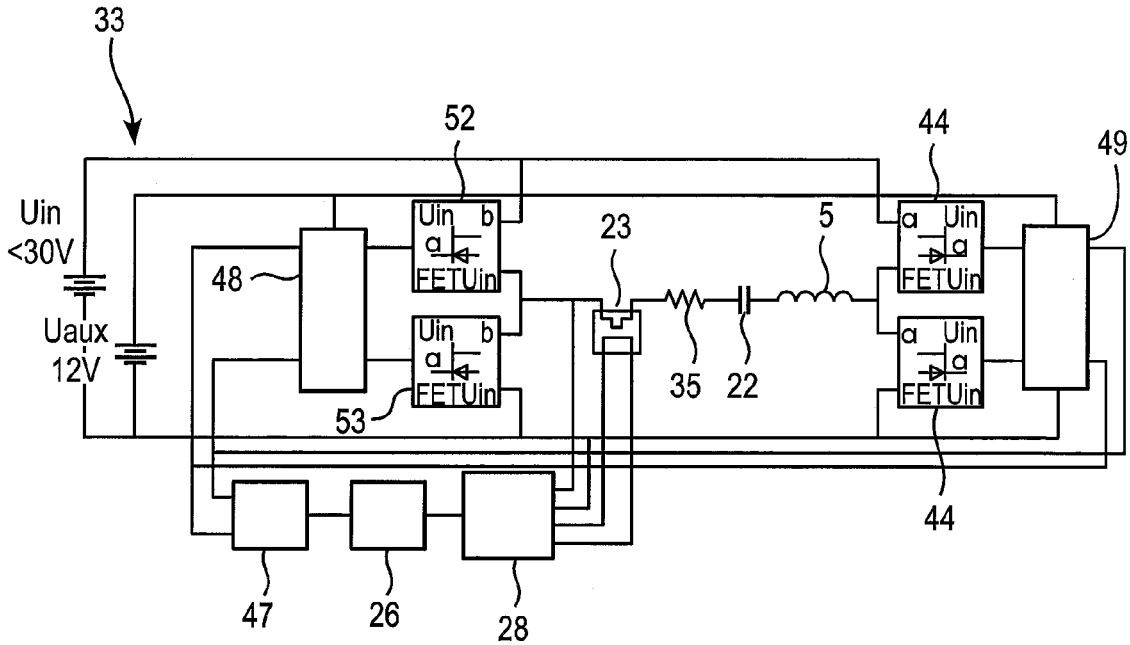
FIG. 12 is an equivalent electric circuit diagram of a device with a high frequency generator and exhibits a class D full bridge with PLL control.

FIG. 12 shows a device with a high frequency generator and a class D full bridge with PLL control. The resonant circuit is configured as a series resonant circuit. The other components and their interconnections match the description with respect to FIG. 11.

Figure 13:
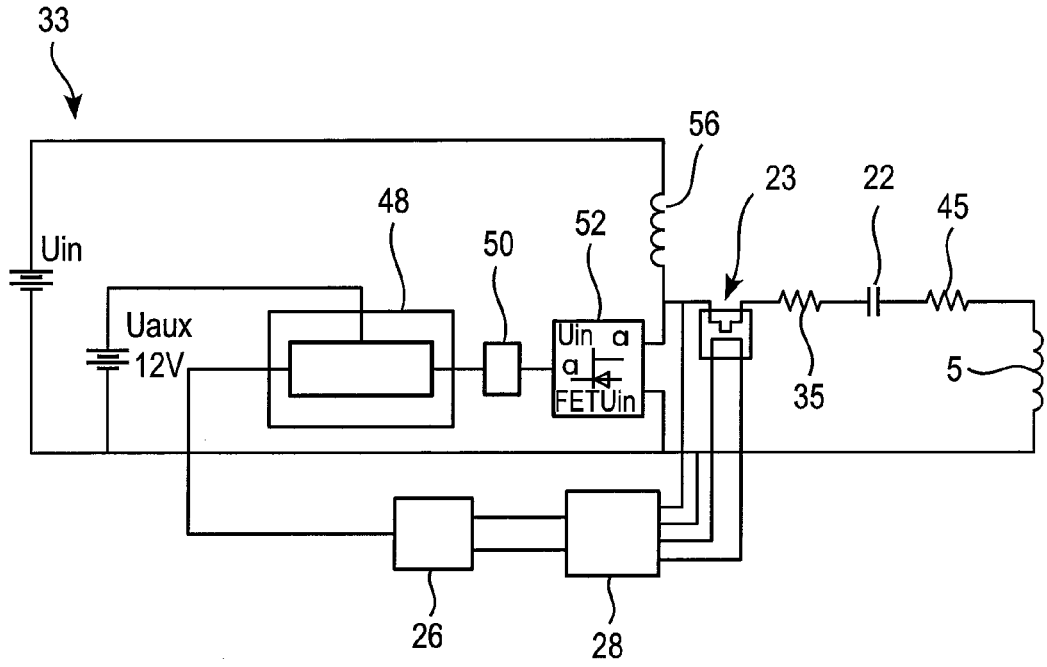
FIG. 13 is an equivalent electric circuit diagram of a device with a high frequency generator and a class E output stage with PLL control.

FIG. 13 shows a device with a high frequency generator and a class E output stage with PLL control. The resonant circuit is configured as a series resonant circuit and comprises the coupling capacitor 22, the coupling coil 5 and the line resistor 35 and the coil resistor 45. Thus, the use of a class E output stage circuit for the high frequency generator with PLL frequency and phase control and resonant circuit coupling, in particular a series/parallel resonant circuit, including the coupling coil, is employed preferably in a frequency and power range between 600 kHz and 30 MHz and/or between 1 W and 500 W. The coil 56 is a component of the class E amplifier and is by a multiple larger than the coil 5. It serves as the energy accumulator, when the output stage 52 is blocked. The other components and their interconnections match the description with respect to FIG. 11.

Figure 14:
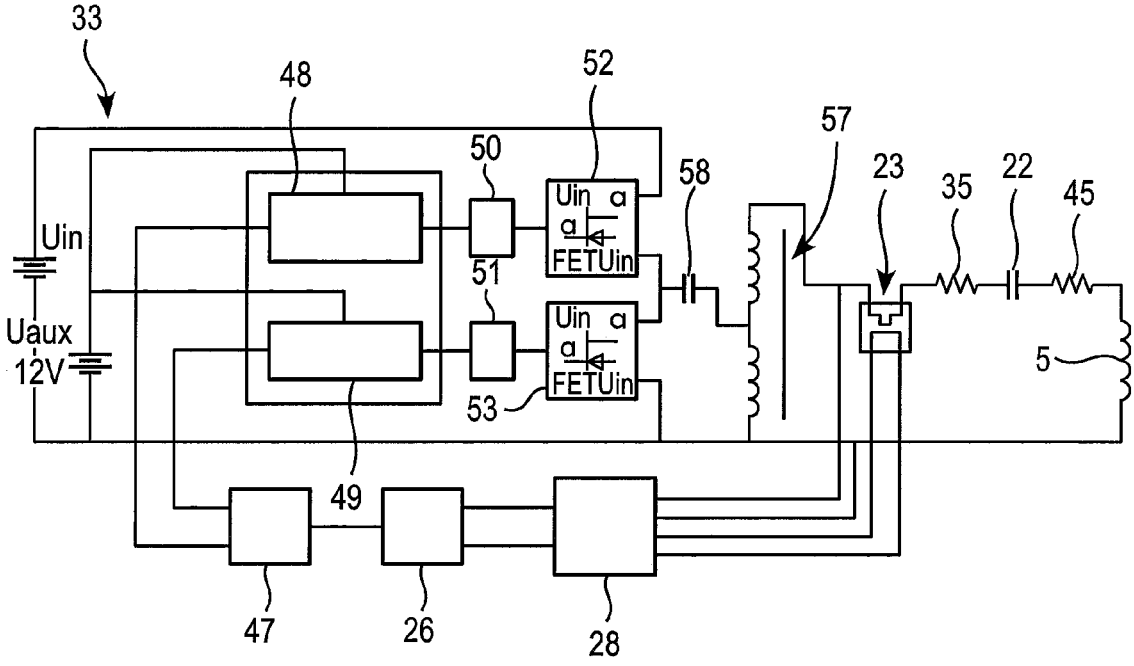
FIG. 14 is an equivalent electric circuit diagram of a device with a high frequency generator and a class D half bridge with PLL control and an additional step-up matching transformer.

FIG. 14 is an equivalent electric circuit diagram of a device with a high frequency generator, a class D half bridge with PLL control and an additional step-up matching of a transformer. To this end, a transformer 57 and a capacitor 58 are connected to the output of the output stages 52, 53. In this case the capacitor 58 is connected in a well-known way to a center tap of the transformer 57. The other components and their interconnections match the description with respect to FIG. 11.

Figure 15:
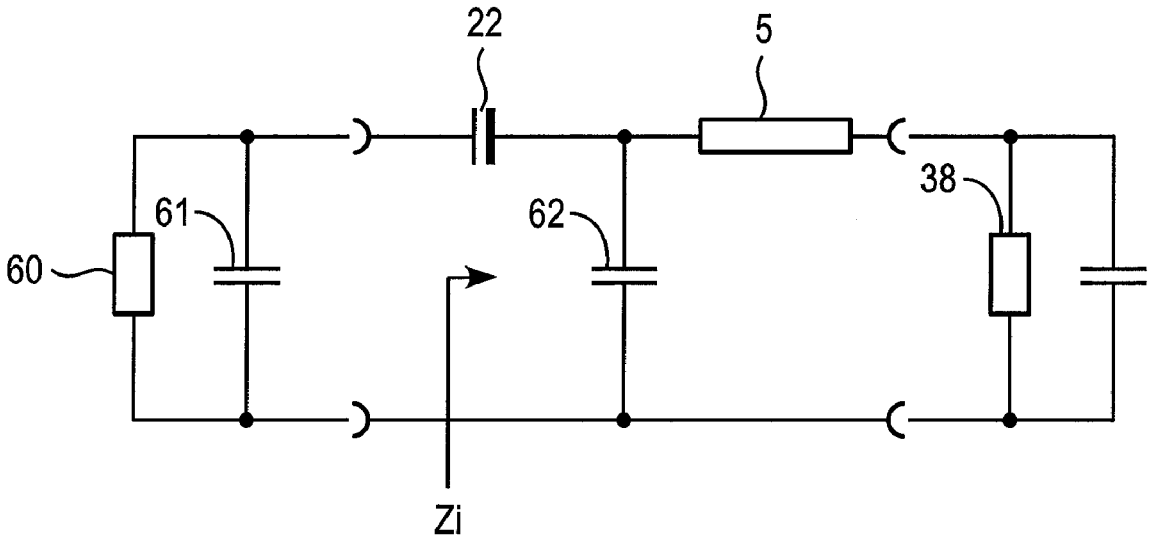
FIG. 15 is a schematic drawing of an impedance transformation at the output of the high frequency generator.

Finally FIG. 15 shows an embodiment of a possible capacitive impedance transformation, which can be used for all amplifier classes (class C, class D, class E, class F). Such an impedance transformation makes it possible to vary the impedance of the plasma and/or an input impedance Zi of the resonant circuit and, thus, to optimize the efficiency, the frequency range and the voltage range (for thrust resolution). The resistor 38 represents the resistance of the plasma. A capacitor 59 can be connected in parallel to the resistor 38. The resistor 60 and the capacitor 61, which is connected in parallel to said resistor, represent elements of the high frequency generator. The capacitors 22, 61 represent the resonance capacitors; the coil 5 is the coupling coil.

The advantage of all of the described variants is that a power coupling of the energy, generated by the high frequency generator, over a wide power and frequency range without intermediate transformation and impedance matching network directly into the plasma of the ion or electron source is possible. Thus, the core of the power matching is the inclusion of the coupling coil, design-induced coupling capacitances between the plasma and the housing of the discharge vessel and the cabling to a series and/or parallel resonant circuit, as well as the automatic frequency and phase control of the high frequency generator.

LIST OF REFERENCE NUMERALS

1 gas tank
2 fill and outflow area
3 flow control unit
4 discharge vessel
5 coupling coil
6 inlet
7 outlet
8 extraction grid
9 direction of ion expulsion
10 neutralizer
11 cathode heater
12 neutralizing unit
13 direction of the electron expulsion
14 insulator
15 flow limiter
16 high frequency generator

17 plasma holder
18 accelerator
19 decelerator
21 propulsion system housing
22 coupling capacitor
23 current measuring device
24 output stage
25 driving circuit
26 voltage-controlled oscillator
27 filter
28 digital phase/comparator
29 signal amplifier
30 signal amplifier
31 input filter
32 input filter
33 energy supply
34 PLL controller
35 resistor
36 transformer
37 secondary side of the transformer 36
38 resistor
39 node
40 resistor
41 node
42 transformer
43 center tap
44 switching element
45 resistor
46 capacitor
47 flip-flop
48, 49 driver stage
50, 51 transformer
52, 53 output stage
54 capacitor
55 capacitor
56 coil
57 transformer
58 capacitor
59 capacitor
60 resistor
61 capacitor
62 capacitor
Uin voltage
Jin current
Zi input impedance The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device, which couples ionization energy into an ion or electron source, which is excited inductively or inductively-capacitively, and which comprises:

a discharge vessel holding a gas which is to be ionized, a coupling coil, which is wound around the discharge vessel and feeds in a high frequency energy, which is required for plasma excitation;

a coupling capacitor, which is electrically coupled to the coupling coil;

a high frequency generator, which is electrically coupled to the coupling coil and which forms together with the at least one coupling capacitor a resonant circuit, the high frequency generator including a PLL controller for automatic impedance matching of the resonant circuit, so that the resonant circuit can be driven at a resonant frequency.

2. The device as claimed in claim 1, wherein the PLL controller carries out a frequency and/or phase control for the impedance matching of the resonant circuit.

3. The device as claimed in claim 1, wherein power control of the high frequency generator is performed by setting an input direct voltage and an input current of the high frequency generator.

4. The device as claimed in claim 1, wherein the high frequency generator is connected to the coupling coil with or without interposing an impedance matching network.

5. The device as claimed in claim 1, wherein the resonant circuit is a series or parallel resonant circuit.

6. The device as claimed in claim 1, wherein the coupling coil has a center tap, to which the high frequency generator is attached.

7. The device as claimed in claim 1, wherein the coupling coil is disposed between two or more coupling capacitors.

8. The device as claimed in claim 1, wherein the high frequency generator is connected to the coupling coil without interposing electronic components for an intermediate transformation.

9. The device as claimed claim 1, wherein the coupling coil is grounded unilaterally.

10. The device as claimed in claim 1, wherein the coupling coil is attached insulated from a ground potential via the resonant circuit.

11. The device as claimed in claim 1, wherein the coupling coil and the plasma form a transformer, the plasma representing a secondary winding of the transformer.

12. The device as claimed in claim 1, wherein a resonant frequency is set in a range of 0.5 MHz to 30 MHz.

13. The device as claimed in claim 1, wherein power that is coupled into the high frequency generator is in a range of 1 W to 10 kW.

14. The device as claimed in claim 1, wherein a load impedance, which is coupled to the high frequency generator, is in a range of 0.1 ohm to 1 ohm or in a range of 1 ohm to 50 ohms.

15. The device as claimed in claim 1, wherein the discharge vessel is made of a non-conducting material exhibiting low high frequency losses.

16. The device as claimed in claim 1, wherein the coupling coil comprises a single layered or a multi-layered or a bifilar winding.

17. The device, as claimed in claim 1, wherein the coupling coil is wound around the discharge vessel or disposed inside the discharge vessel.

18. The device as claimed in claim 1, wherein the coupling coil is wound about the discharge vessel of the corresponding shape in a cylindrical, conical, spherical or partially conical manner with a cylindrical transition body.

19. The device as claimed in claim 1, wherein coupling capacitor and the coupling coil are attached to the high frequency generator by way of a transformer.

20. The device as claimed in claim 19, wherein on the primary side the transformer is capacitively coupled to the high frequency generator and on the secondary side to the at least one coupling capacitor, and the coupling coil forms the resonant circuit.

21. The device as claimed in claim 1, wherein the high frequency generator comprises a power output stage.

22. The device as claimed in claim 21, wherein the power output stage is one of a half bridge class D output stage;

a full bridge class D output stage;

a push pull output stage;

a output stage of class E;

a output stage of class F; or a output stage of class C.

23. A device, which couples ionization energy into an ion or electron source, which is excited inductively or inductively-capacitively, and which comprises:

a discharge vessel holding a gas which is to be ionized, a coupling coil, which is wound around the discharge vessel and feeds in a high frequency energy, which is required for plasma excitation;

a coupling capacitor, which is electrically coupled to the coupling coil;

a high frequency generator, which is electrically coupled to the coupling coil and which forms together with the at least one coupling capacitor a resonant circuit, the high frequency generator including a PLL controller for automatic impedance matching of the resonant circuit, so that the resonant circuit can be driven at a resonant frequency, wherein coupling capacitor and the coupling coil are attached to the high frequency generator by way of a transformer, wherein on the primary side the transformer is capacitively coupled to the high frequency generator and on the secondary side to the at least one coupling capacitor, and the coupling coil forms the resonant circuit a device that measures current and the voltage in the resonant circuit and which is coupled to the PLL controller, in order to feed the measured current and the measured voltage as the controlled variables to the PLL controller.

24. The device, as claimed in claim 1, wherein the coupling capacitor is disposed in the high frequency generator or outside this high frequency generator.

25. A device, which couples ionization energy into an ion or electron source, which is excited inductively or inductively-capacitively, and which comprises:

a discharge vessel holding a gas which is to be ionized, a coupling coil, which is wound around the discharge vessel and feeds in a high frequency energy, which is required for plasma excitation;

a coupling capacitor, which is electrically coupled to the coupling coil;

a high frequency generator, which is electrically coupled to the coupling coil and which forms together with the at least one coupling capacitor a resonant circuit, the high frequency generator including a PLL controller for automatic impedance matching of the resonant circuit, so that the resonant circuit can be driven at a resonant frequency, wherein the discharge vessel includes a gas inlet and an outlet, which is configured opposite said gas inlet, with at least two extraction grids, each of which has one multi-apertured mask, which serves as the electric lens for focusing the ion beams that are to be extracted.

26. The device, as claimed in claim 25, wherein an electric field is applied to the extraction grids.

* * * * *